US005577833A

United States Patent [19]

English et al.

[11] Patent Number: 5,577,833

[45] Date of Patent: Nov. 26, 1996

[54] VEHICLE HEADLAMP REFLECTOR

[75] Inventors: George J. English, Reading, Mass.; Robert L. King, Seymour, Ind.

[73] Assignee: Osram Sylvania Inc., Danvers, Mass.

[21] Appl. No.: 489,913

[22] Filed: Jun. 13, 1995

[51] Int. Cl.[6] ..... F21V 7/04

[52] U.S. Cl. ..... 362/297; 362/61; 362/346; 362/348

[58] Field of Search ..... 362/61, 80, 215, 362/297, 342, 346, 348

[56] References Cited

U.S. PATENT DOCUMENTS

| | | | |
|---|---|---|---|
| 1,572,853 | 2/1926 | Balsillie | 362/348 |
| 1,793,662 | 2/1931 | Wood | 362/211 |
| 2,108,286 | 2/1938 | Godley | 362/215 |
| 2,565,757 | 8/1951 | Coulter | 362/215 |
| 3,511,983 | 5/1970 | Dorman | 362/297 |
| 4,351,018 | 9/1982 | Fratty | 362/348 |
| 4,916,585 | 4/1990 | Nino | 362/297 |
| 5,034,867 | 7/1991 | Mayer | 362/297 |

*Primary Examiner*—Ira S. Lazarus
*Assistant Examiner*—Alan B. Cariaso
*Attorney, Agent, or Firm*—William E. Meyer

[57] ABSTRACT

A vehicle headlamp reflector comprises a concave shell having a reflective surface, the shell including multiple vertical panels defining the reflective surface. The panels include at least one panel having therein on the reflective surface multiple vertical ribs defining alternating ridges and grooves. The ridges and grooves are of a rounded configuration, of substantially equal width throughout their lengths, and extend substantially from top to bottom of the panel.

5 Claims, 3 Drawing Sheets

VEHICLE HEADLAMP REFLECTOR

BACKGROUND OF THE INVENTION

1. Field of the Invention

The invention relates to vehicle headlamps and is directed more directly to a reflector for such headlamps.

2. Description of the Prior Art

Headlamps for vehicles are commonly constructed such that a light source is positioned at the focal point of a parabolic reflector. In theory, this should produce a beam comprising a bundle of parallel rays pointed forwardly of the vehicle, with a concentrated "hot spot" in the axial center of the beam. In practice, the rays do not conform to the theoretical model. The light source is not a point source, producing diffusion of rays or "stray" light. Stray light above the horizontal is lost uselessly and is offensive and/or blinding to oncoming drivers. The immediate areas in front of the vehicle and to either side of the vehicle typically are under lit. Repointing the beam downwardly merely reduces the beam reach. There is a need for a reflector that spreads the beam horizontally from the axial hot spot.

Vehicle styling with aerodynamic shaping has limited the outer shell of the headlamp to a generally elongated, relatively narrow, rectangle. Large portions of the upper and lower surfaces of the parabolic reflector have been sacrificed to styling. Accordingly, the remaining portions must be shaped so as to efficiently project the available light to those parts of the road helpful to the driver, and not to areas that blind oncoming drivers and pedestrians. There is thus a need for a reflector which spreads the beam appropriately and which conforms to aerodynamic styling.

In an attempt to provide a reflector which solves the above described problems, reflectors have been provided which comprise a multitude of reflective panels joined together in a generally parabolic surface. Typically, the configuration of each panel is computer generated to provide light rays to a desired portion of the road. In manufacture of reflectors, after the panels are joined together, the reflective surface is coated with a material and, thereafter, aluminized. The coating, at and immediately after the time of application, tends to accumulate in the seams, or junctures, of the panels, usually running down a vertical seam until encountering a horizontal seam, at which point the coating material collects and hardens, forming irregularities in the surface of the reflector. Such irregularities can produce glare zones in the light pattern. Accordingly, there is a need for a reflector, as discussed above, and further having sections joined together in such a manner as to avoid formation of irregular beam patterns and consequent glare zones.

As headlamps have become smaller and the reflectors therein smaller, in response to styling mandates, it has become necessary to provide more intense light sources, such as High Density Discharge (HID) light sources. The result has been that a relatively small reflector surface is responsible for lighting a particular region. When a human eye in that region views the headlamp, the eye sees an intense light from the small region and experiences the light as brilliant and often blinding. When the same amount of light is received from a greater area, the eye is more tolerant. There is, therefore, a need for a vehicle headlamp reflector which casts a beam appropriately spread horizontally, which reflector is adapted to aerodynamic styling, avoids the formation of surface irregularities in its manufacture during the overcoating process, and which spreads the reflective surface as seen by the eye of an oncoming driver.

In U.S. Pat. No. 1,793,662, issued Feb. 24, 1931, in the name of W. H. Wood, there is disclosed a headlamp reflector having vertical bands through a portion of a metal reflector. The vertical bands appear to be formed in the reflector by vertical grooves in the metal.

U.S. Pat. No. 2,108,286, issued Feb. 15, 1938, in the name of C. E. Godley, shows a headlamp reflector with horizontal bands having different curvatures to spread and direct the light from the light source.

U.S. Pat. No. 3,511,983, issued May 12, 1970, in the name of W. H. Dorman, discloses a lighting device for dental and surgical procedures having a concave glass mirror surface with vertical rows or facets therein which are, alternatively, of convex or concave configuration. Between the rows are grooves, or, alternatively, ridges.

SUMMARY OF THE INVENTION

An object of the invention is to provide a vehicle headlamp reflector which tilts images of the filament down to and below the horizon to reduce glare to on-coming drivers.

A further object of the invention is to provide a vehicle headlamp reflector which spreads a projected beam horizontally from an axial hot spot.

A further object of the invention is to provide such a reflector as may be configured to conform to aerodynamic styling.

A further object of the invention is to provide such a reflector, the reflective surface of which is substantially devoid of irregularities caused by collecting of overcoating material during and following the overcoating process.

A still further object of the invention is to provide such a reflector which serves to spread the reflector area from which a beam region is reflected, such that the intensity of a beam portion viewed from a distal portion of the beam is more tolerantly received by a human eye.

With the above and other objects in view, as will hereinafter appear, a feature of the present invention is the provision of a vehicle headlamp reflector comprising a concave shell having a reflective surface, the shell comprising multiple vertical panels defining the reflective surface and tilt of the beam. The panels include at least one panel having therein on the reflective surface multiple vertical ribs defining alternating ridges and grooves. The ridges and grooves are of a rounded configuration, of substantially equal width throughout their lengths, and extending substantially from top to bottom of the panel.

The above and other features of the invention, including various novel details of construction and combinations of parts, will now be more particularly described with reference to the accompanying drawings and pointed out in the claims. It will be understood that the particular reflector embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENT

Figure 1:
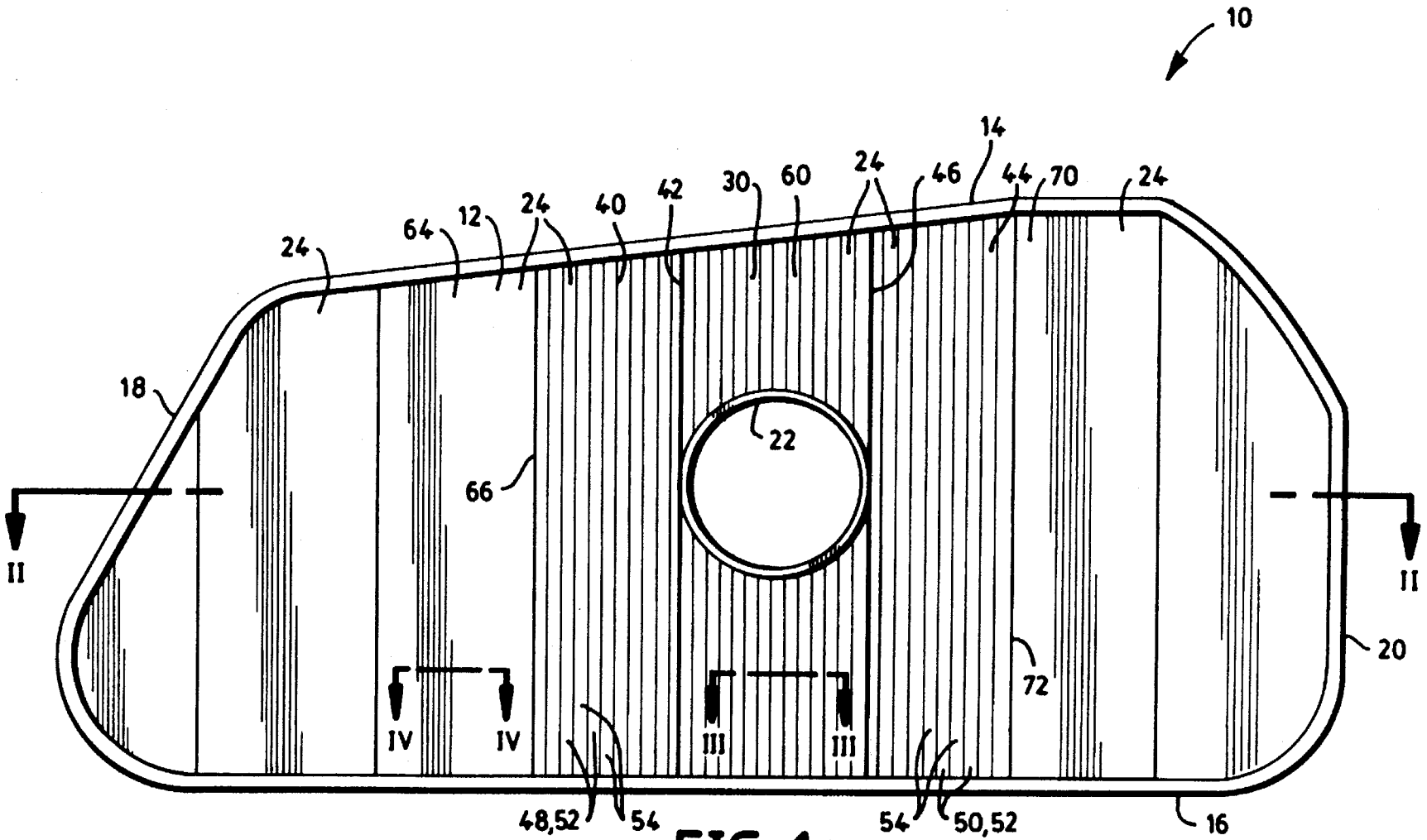
FIG. 1 is a front elevational view of one form of vehicle headlamp reflector illustrative of an embodiment of the invention.
Figure 2:
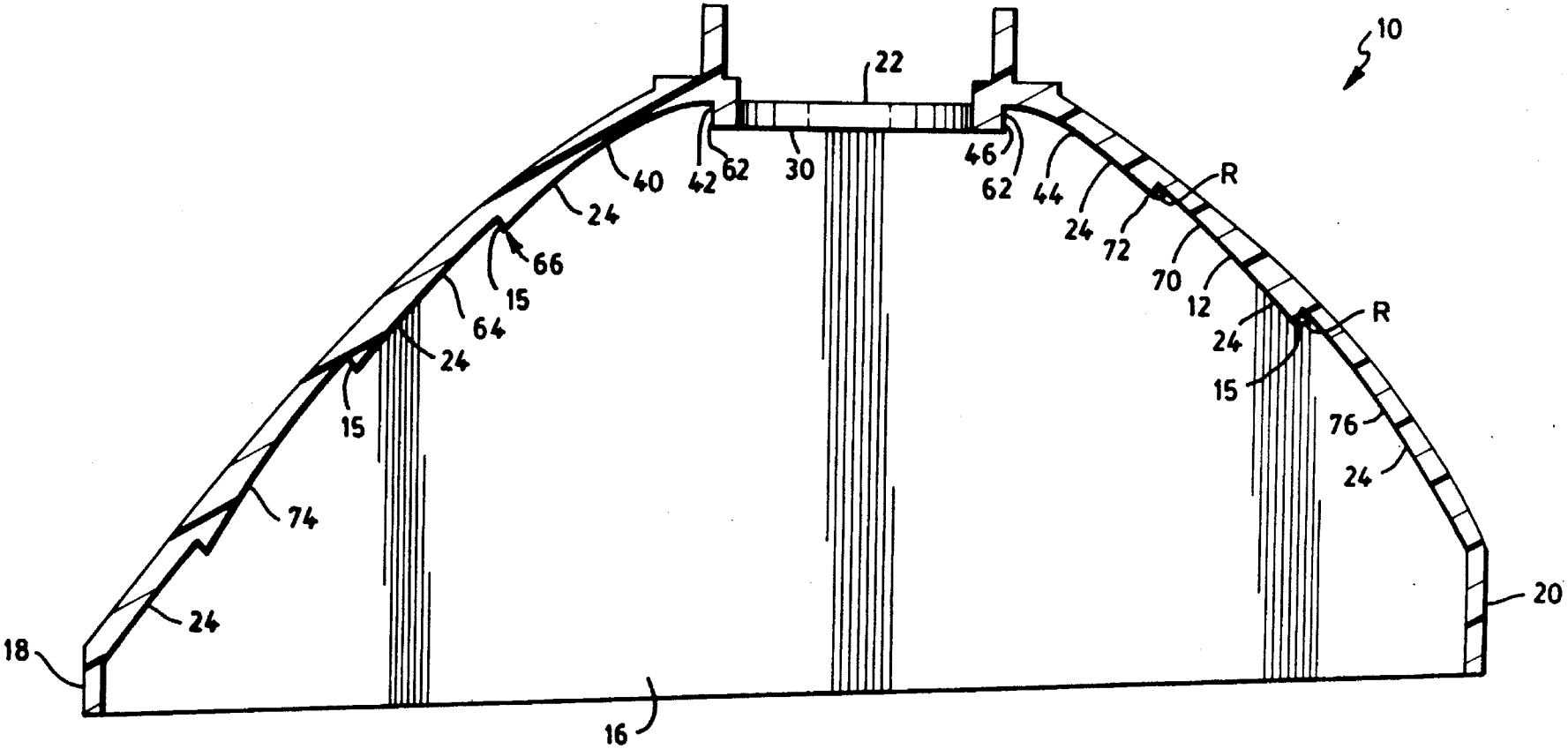
FIG. 2 is a sectional view taken along line II—II of FIG. 1.

Referring to FIGS. 1 and 2, it will be seen that an illustrative embodiment of the inventive vehicle headlamp reflector comprises a concave shell 10 having a reflective surface 12. The shell 10 preferably is of a rigid plastic material to which is applied an overcoating of resinous material, followed by aluminizing to provide the smooth, highly reflective mirror-like surface 12. The shell is formed in a generally paraboloidal, ellipsoidal, or hyperbolic configuration, or in complex combinations thereof, to provide the concavity of the shell.

The shell customarily is provided with a forwardly-extending top wall 14, bottom wall 16, and side walls 18, 20. The walls are configured to provide, in cooperation with a lens, the front and, in many cases, the side-facing surface of the headlamp. A hole 22 is located approximately in the center of the concavity, vertically and horizontally. Thus, roughly equal portions of the reflector are disposed on either side, and above and below, the hole 22. The hole is adapted to receive a light source (not shown) which is accordingly positioned roughly in the center of the reflector. An optical axis extends from the light source forwardly and downwardly.

Figure 3:
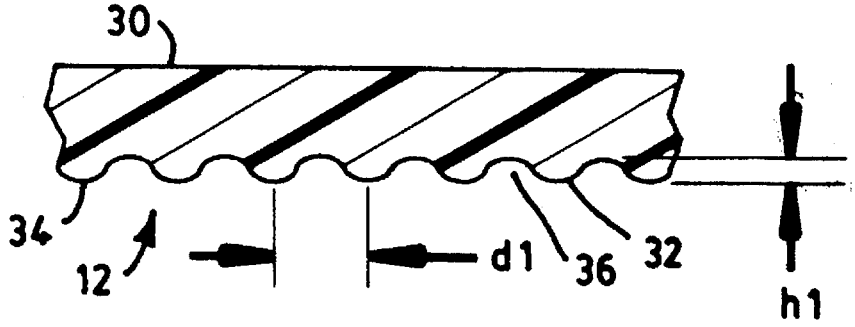
FIG. 3 is a sectional view taken along line III—III of FIG. 1.

The shell is made up of multiple vertical panels 24 which define, in part, the reflective surface 12 and which tilt, and form a first portion of an appropriate beam spread. The panels 24 include a first panel 30, usually disposed in the center of the shell 10, extending substantially from the top wall 14 to the bottom wall 16. The first panel 30 is provided with vertical ribs 32 defining alternating ridges 34 and grooves 36 (FIG. 3). The ridges 34 and grooves 36 are of substantially equal width throughout their lengths, and extend substantially from top to bottom of the first panel 30. The ridges 34 and grooves 36 form a second portion of the beam spread for this panel. The ridges 34 and grooves 36 are of a rounded configuration, as shown in FIG. 3, providing ease of molding and extraction from molds, and further providing the desired horizontal spread of light from the light source reflected from the series of ridges 34 and grooves 36.

The shell panels 24 preferably include a second panel 40 adjacent the first panel 30 on a first side edge 42 of the first panel 30, and a third panel 44 adjacent the first panel 30 on a second side edge 46 of the first panel. The second and third panels 40, 44 are provided, on the reflective surface 12, with multiple vertical ribs 48, 50, respectively, defining alternating ridges and grooves 52, 54 of a rounded configuration, of substantially equal width throughout their lengths, and extending substantially from top to bottom of the second and third panels 40, 44.

The rounded configuration of the ridges 34 and grooves 36 of the first panel, and ridges 52 and grooves 54 of the second and third panels may be of a sinusoidal configuration in cross-section (FIG. 3).

Referring to FIG. 2, it will be seen that the second and third panels 40, 44 are stepped rearwardly relative to the central panel 30. Inasmuch as the vertical panels 24 extend substantially from the top wall 14 to the bottom wall 16, there are no horizontal seams intersecting the junctures of the panels with each other. Also, inasmuch as the second and third panels are stepped rearwardly of the central panel, no vertical grooves or channels are formed which might retain the overcoating material on the reflective surface 12 when it is applied. Upon application of the overcoating material, any excess R thereof washes down or behind a forward edge 15 of each panel, without accumulating and setting up on the reflective surface 12 (FIG. 2A).

Figure 4:
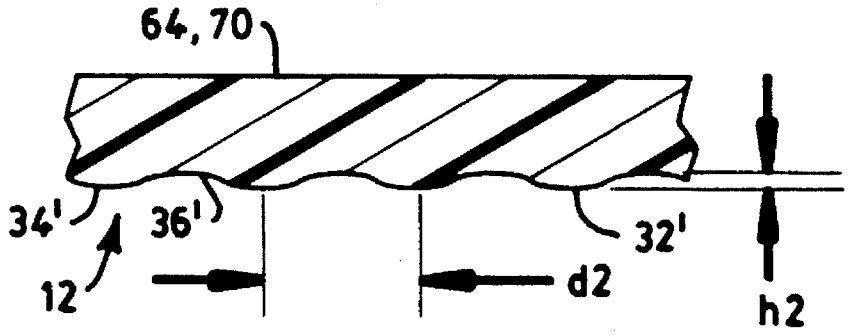
FIG. 4 is a sectional view taken along line IV—IV of FIG. 1.

The vertical panels 24 may include a fourth panel 64 adjacent the second panel 40 at an edge 66 of the second panel 40 remote from the central panel 30. The vertical panels 24 may further include a fifth panel 70 adjacent the third panel 44 at an edge 72 of the third panel 44 remote from the central panel 30. At least one of the fourth and fifth panels 64, 70 may be provided on the reflective surface thereof with multiple vertical ribs 32' defining alternating ridges 34' and grooves 36' of a rounded configuration (FIG. 4) having a larger radius of curvature than the ridges 34 and grooves 36 of the central, second and third panels 30, 40, 44 (FIG. 3). The ridges 34' and grooves 36' of the fourth and fifth vertical panels 64, 70 extend substantially from top to bottom of one or both of the fourth and fifth panels 64, 70 and are of substantially equal width throughout their lengths. The ridges 34' of the fourth and fifth panels 64, 70 are of lesser height $h_2$ (FIG. 4), relative to the grooves 36', than the height $h_1$ (FIG. 3) of the ridges 34 of the central, second and third panels 30, 40, 44, relative to the grooves 36 of those panels. The distance $d_2$ (FIG. 4) from mid-ridge to mid-ridge in at least one of the fourth and fifth panels 64, 70 is greater than the distance $d_1$ (FIG. 3) from mid-ridge to mid-ridge in the central, first and second panels 30, 40, 44.

The fourth panel 64 is stepped rearwardly relative to the second panel 40 at the juncture of the panels 40, 64. The fifth panel 70 is stepped rearwardly relative to the third panel 44 at the juncture of the panels 44, 70.

The reflector may include at least one additional panel 74 outboard of the fourth panel 64 and stepped rearwardly of the fourth panel 64 at the juncture of the fourth and one additional panels 64, 74, and at least one additional panel 76 outboard of the fifth panel 70 and stepped rearwardly from the fifth panel 70. The additional panels 74, 76 may be devoid of any vertical ribs on the reflective surfaces thereof.

In operation, a light source, such as a high intensity discharge lamp (not shown), is disposed in the reflector hole 22 and emits light rays which are reflected forwardly from all of the vertical panels 30, 40, 44, 64, 70, 74 and 76. The concave configuration of the reflective surface 12 formed by the vertical panels, generally a paraboloid, an ellipsoid, or hyperbolic configuration, effects horizontal spread. The sinusoidal ribs serve to fine tune the horizontal spread and further serve to cause intermixing and spreading of colors emanating from the HID light source, both at the reflector and in the projected beam. The vertical panels, besides forming the concave reflective surface and thereby contributing to horizontal spread, further serve to define a sharp "cut-off" for the composite beam, reducing glare and stray light.

There is thus provided a vehicle headlamp reflector which operates to spread a projected beam horizontally from the axial "hot-spot", and which may be configured to conform to aerodynamic styling. The reflector so provided is substantially devoid of irregularities in the light beam usually caused by collections of overcoating material on the headlamp causing lack of uniformity in the reflective surface. The intensity of the beam origin is such that when viewed from a point forwardly of the lamp the beam origin, or source, is more tolerantly received by a human eye.

It is to be understood that the present invention is by no means limited to the particular construction herein disclosed and/or shown in the drawings, but also comprises any modifications or equivalents within the scope of the claims.

Having thus described our invention, what we claim as new and desire to secure by Letters Patent of the United States is:

1. A vehicle headlamp reflector comprising:

a concave shell having a reflective surface; said shell comprising multiple vertical panels defining said reflective surface; said panels including a central panel having therein on said reflective surface multiple vertical ribs defining alternating ridges and grooves; said ridges and grooves being of a rounded configuration, of substantially equal width throughout their lengths, and extending substantially from top to bottom of said panel, and including a second panel adjacent said central panel on a first side edge of said central panel and a third panel adjacent said central panel on a second side edge of said central panel, said second and third panels having on said reflective surface multiple vertical ribs defining alternating ridges and grooves of a rounded configuration, of substantially equal width throughout their lengths, and extending substantially from top to bottom of said second and third panels, wherein said second and third panels are stepped rearwardly relative to said central panel and extended forwardly of said central panel.

2. The reflector in accordance with claim 1, wherein said panels include a fourth panel adjacent said second panel at an edge of said second panel remote from said central panel, and a fifth panel adjacent said third panel at an edge of said third panel remote from said central panel, at least one of said fourth and fifth panels having on said reflective surface multiple vertical ribs defining alternating ridges and grooves of a more rounded configuration with a larger radius of curvature than said ridges and grooves of said central, second and third panels, of substantially equal width throughout their lengths, and extending substantially from top to bottom of said at least one of said fourth and fifth panels, said ridges of said at least one of said fourth and fifth panels being of lesser height relative to said grooves of said fourth and fifth panels than said ridges of said central, second and third panels relative to said grooves of said central, second and third panels, the distance from mid-ridge to mid-ridge in said at least one of said fourth and fifth panels being greater than the distance from mid-ridge to mid-ridge in said central, second, and third panels.

3. The reflector in accordance with claim 1, wherein said panels include a fourth panel adjacent said second panel at an edge of said second panel remote from said central panel, and a fifth panel adjacent said third panel at an edge of said third panel remote from said central panel, at least one of said fourth and fifth panels having on said reflective surface multiple vertical ribs defining alternating ridges and grooves, said ridges of said at least one of said fourth and fifth panels being of lesser height relative to said grooves of said fourth and fifth panels than the height of said ridges of said central, second and third panels relative to said grooves of said central, second, and third panels, the mid-ridge to mid-ridge distance in said at least one of said fourth and fifth panels being greater than the mid-ridge to mid-ridge distance in said central, second, and third panels, said fourth panel being stepped rearwardly relative to said second panel and said fifth panel being stepped rearwardly relative to said third panel.

4. The reflector in accordance with claim 3, wherein said panels include at least one additional panel outboard of said fourth panel and stepped rearwardly of said fourth panel, and at least one additional panel outboard of said fifth panel and stepped rearwardly from said fourth panel.

5. The reflector in accordance with claim 2, wherein said panels include at least one additional panel outboard of said fourth panel and at least one additional panel outboard of said fifth panel, said outboard panels being devoid of vertical ribs on said reflective surface.

* * * * *